US010636591B1

(12) United States Patent
Lin

(10) Patent No.: US 10,636,591 B1
(45) Date of Patent: Apr. 28, 2020

(54) WATERPROOF BUTTON MODULE

(71) Applicants: Inventec (Pudong) Technology Corporation, Shanghai (CN); INVENTEC CORPORATION, Taipei (TW)

(72) Inventor: Yi-Chou Lin, Taipei (TW)

(73) Assignees: Inventec (Pudong) Technology Corporation, Shanghai (CN); INVENTEC CORPORATION, Taipei (TW)

( * ) Notice: Subject to any disclaimer, the term of this patent is extended or adjusted under 35 U.S.C. 154(b) by 0 days.

(21) Appl. No.: 16/221,572

(22) Filed: Dec. 16, 2018

(30) Foreign Application Priority Data

Nov. 28, 2018 (CN) ..... 2018 1 1435684

(51) Int. Cl.
*H01H 13/06* (2006.01)
*H01H 9/04* (2006.01)
*H01H 13/12* (2006.01)

(52) U.S. Cl.
CPC ..... *H01H 13/06* (2013.01); *H01H 9/04* (2013.01); *H01H 13/12* (2013.01); *H01H 2223/002* (2013.01)

(58) Field of Classification Search
CPC ..... H01H 13/06; H01H 9/04; H01H 13/12; H01H 2223/002
See application file for complete search history.

(56) References Cited

U.S. PATENT DOCUMENTS 3,950,627 A * 4/1976 Murata ..... H01H 13/12 200/530
7,355,137 B2 * 4/2008 Kawasaki ..... H01H 13/86 200/302.1
7,420,136 B2 * 9/2008 Goetzl ..... H01H 13/06 200/302.2
7,498,537 B1 * 3/2009 Duwel ..... H01H 13/705 200/5 A
9,529,391 B2 * 12/2016 Ely ..... G06F 1/1656
2009/0020402 A1 * 1/2009 Ichikawa ..... H01H 13/06 200/341
2009/0236207 A1 * 9/2009 Shi ..... H01H 13/06 200/302.2
2011/0005908 A1 * 1/2011 Lin ..... H01H 13/063 200/302.2
2013/0163395 A1 * 6/2013 Ferri ..... H01H 13/06 368/290

* cited by examiner

*Primary Examiner* — Kyung S Lee
(74) *Attorney, Agent, or Firm* — CKC & Partners Co., LLC

(57) ABSTRACT

A waterproof button module includes a casing, a button, a resilient member, and a first waterproof portion. The casing has a first recess and a first through hole located at a bottom of the first recess. The button is located in the first recess and partially passes through the first through hole. The resilient member is located in the first recess. The button and the bottom of the first recess are respectively located on opposite sides of the resilient member. The first waterproof portion surrounds the first through hole and abuts against the resilient member and the first recess in an airtight manner.

8 Claims, 5 Drawing Sheets

WATERPROOF BUTTON MODULE

CROSS-REFERENCE TO RELATED APPLICATION

This application claims priority to China Application Serial Number 201811435684.2, filed on Nov. 28, 2018, which is herein incorporated by reference in its entirety.

BACKGROUND

Field of Invention

The present disclosure relates to a button module, and particularly, to a waterproof button module in an electronic device.

Description of Related Art

A conventional waterproof button includes a waterproof rubber, a spring, and a retaining ring. Due to the coordination of the above-mentioned components and the casing of the device in which the waterproof button is configured, the conventional waterproof button may realize the waterproof effect. More specifically, the waterproof rubber is movably sandwiched between the casing and the button. The spring is located between the casing and the button and disposed along the moving direction of the button, such that the button may rebound to the initial position thereof after being pressed. The retaining ring is located on the button and movably abuts against the casing, such that the button may be fixed at the initial position thereof after rebounding.

However, components of the conventional waterproof button are too many to be easily assembled. In addition, since the spring of the button requires an operating space, it would be difficult to reduce the volume of the button. Furthermore, since the waterproof rubber is movably configured between the button and the casing, when the waterproof rubber is aged and/or hardened due to long-term use, structural breakage may occur to the waterproof rubber. Therefore, a leak may occur between the button and the casing, in such a way that the performance of the conventional waterproof button would be significantly deteriorated.

In other words, the conventional waterproof button is not only difficult to be assembled but also confronts doubts about leakage after being used over a period of time. Hence, it is desirable to come up with a waterproof button module capable of tackling the above-mentioned problems.

SUMMARY

In accordance with one or more embodiments of the present disclosure, a waterproof button module is provided and includes a casing, a button, a resilient member, and a first waterproof portion. The casing has a first recess and a first through hole located at a bottom of the first recess. The button is located in the first recess and partially passes through the first through hole. The resilient member is located in the first recess. The button and the bottom of the first recess are respectively located on opposite sides of the resilient member. The first waterproof portion surrounds the first through hole and abuts against the resilient member and the first recess in an airtight manner.

In some embodiments, the button includes a body and a pressing portion extending from a bottom surface of the body, and the resilient member includes a first portion and a second portion. The first portion is below the bottom surface of the body. The second portion is connected to the first portion, extends through the first through hole, and has a hollow that accommodates the pressing portion.

In some embodiments, the button further includes an enforcement rib connected between the bottom surface of the body and the pressing portion.

In some embodiments, the resilient member further includes a support portion connected to a top surface of the first portion, abutting against the bottom surface of the body, and surrounding the second portion.

In some embodiments, the support portion and the first waterproof portion are located on opposite sides of the first portion respectively and aligned with each other.

In some embodiments, the casing further includes a second recess having a bottom at which the first recess is formed.

In some embodiments, the waterproof button module further includes a button fixing component in the second recess and having a second through hole, wherein the button passes through the second through hole.

In some embodiments, the waterproof button module further includes a second waterproof portion surrounding the button and abutting against the button fixing component and the second recess in an airtight manner.

In some embodiments, the button includes a body and a protruding portion connected to a side surface of the body and movably abutting against a bottom surface of the button fixing component.

In some embodiments, the waterproof button module further includes a printed circuit board (PCB) fixed to the casing and having a button switch, wherein the resilient member abuts against and is between the button switch and the button.

Further herein described, according to one or more embodiments of the waterproof button module, the waterproof button module of the present disclosure may achieve a good waterproof performance through the configuration of the resilient member with specific shape and configuration of the waterproof portion between the button and the casing. In detail, the resilient member may cover the bottom of the button and the pressing portion. Further, the resilient member may be bonded to the bottom of the first recess of the casing through the first waterproof portion with an annular shape. The pressing portion of the button may penetrate through the bottom of the first recess of the casing, so as to press the button switch in the casing through the resilient member. The button, the resilient member, the first waterproof portion and the casing are sequentially stacked from top to bottom, such that external liquid cannot intrude into the casing via the through hole at the bottom of the first recess. On the other hand, the resilient member may include a support portion which is disposed on the top surface thereof and configured to abut against the bottom of the button. After the button is pressed, a reverse force from the resilient member may be applied to the bottom of the button through the support portion, such that the button may be rebounded back to its original position accordingly. Consequently, the waterproof button module of the present disclosure may replace the conventional spring with the resilient member to further reduce the volume thereof. In addition, the resilient member and the waterproof portion of the present disclosure may be configured to be stationary, such that frictional damage to the resilient member and the waterproof portion may be avoided, and thus life expectancy of the waterproof button module may be prolonged.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. The dimensions of the various features may be arbitrarily increased or reduced for clarity of discussion.

DETAILED DESCRIPTION

Figure 1:
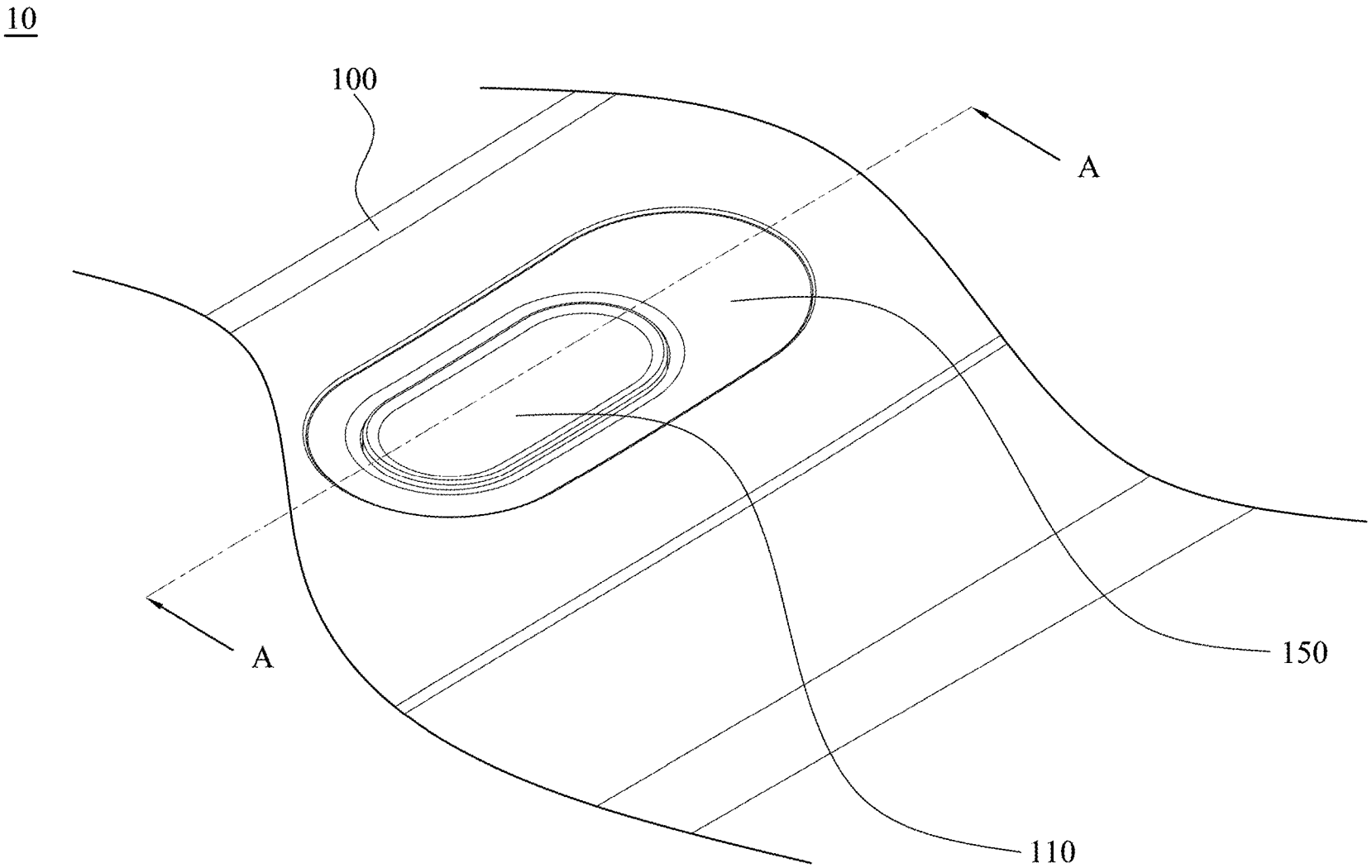
FIG. 1 is a schematic diagram illustrating a perspective view of a waterproof button module in accordance with some embodiments of the present disclosure.

The following disclosure provides various embodiments, or examples, for implementing various features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one component or feature's relationship to another component(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

Reference is made to FIG. 1, which is a schematic diagram illustrating a perspective view of a waterproof button module 10 in accordance with some embodiments of the present disclosure. In some embodiments, the waterproof button module 10 includes a casing 100 and a button 110. The button 110 is fixed to the casing 100 through a button fixing component 150. Due to the embedded configuration of the waterproof button module 10, the top surfaces of the button 110 and the button fixing component 150 may be substantially coplanar with the top surface of the casing 100. Consequently, the waterproof button module 10 of the present disclosure may reduce the contact area with external space, such that intrusion of liquid from external space into the casing 100 may be minimized. On the other hand, due to the coplanar configuration described above, the appearance of the device may be streamlined, such that a comfortable operating experience may be provided to a user. More detailed descriptions about structural features of the waterproof button module 10 will be presented as follows in coordination with other figures of the present disclosure.

Figure 2:
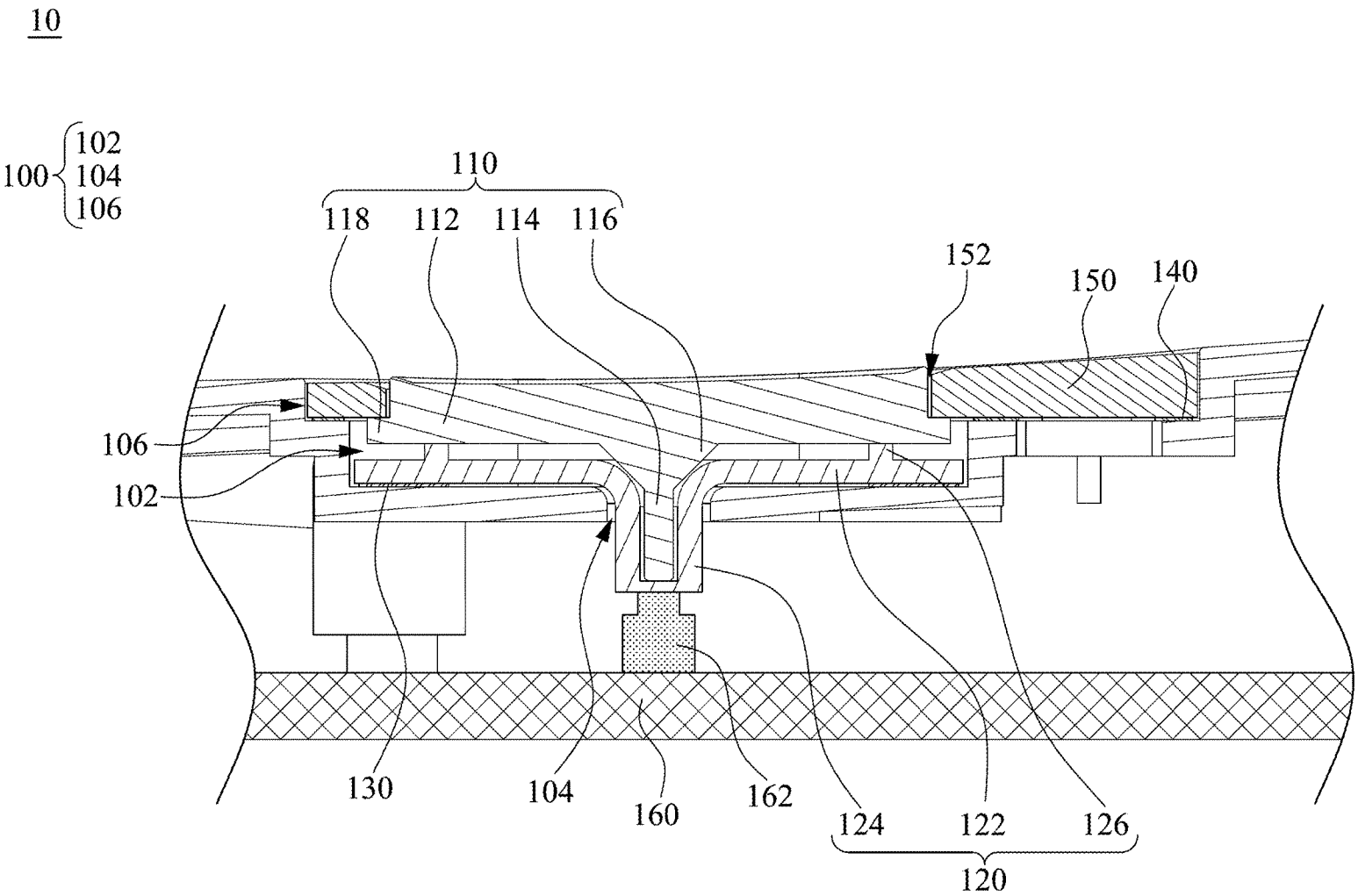
FIG. 2 is a cross section of the waterproof button module in FIG. 1 depicted along line A-A therein.

Reference is made to FIG. 2, which is a cross section of the waterproof button module 10 in FIG. 1 depicted along line A-A therein. In some embodiments, the casing 100 has a first recess 102 and a first through hole 104. The first through hole 104 may be located at a bottom of the first recess 102. The button 110 may be partially accommodated in the first recess 102 and partially pass through the first through hole 104. The waterproof button module 10 may further include a resilient member 120 and a first waterproof portion 130. The resilient member 120 is accommodated in the first recess 102. The button 110 and the bottom of the first recess 102 are spaced apart from each other and respectively located on opposite sides of the resilient member 120. The first waterproof portion 130 may surround the first through hole 104 and respectively abut against the resilient member 120 and the first recess 102 in an airtight manner.

In some embodiments, the waterproof button module 10 includes a printed circuit board (PCB) 160 that is configured in and fixed to the casing 100. In addition, the PCB 160 may include a button switch 162. The button 110 may press the button switch 162 through the resilient member 120 for turning on or turning off the button switch 162. Due to the configuration of the waterproof button module 10, the casing 100 may excellently prevent intrusion of external liquid, such that the safety of the PCB 160 and the button switch 162 may be ensured.

In some embodiments, the first recess 102 is located below the surface of the casing 100 and also accommodates a portion of the button 110 and the resilient member 120. The first recess 102 may have a rectangular cross section. That is, the first recess may have a vertical sidewall. In addition, the contour of the first recess 102 and contour of the button 110 may be conformal. In other words, the first recess 102 and the button 110 may have respective contours with substantially the same shape but different sizes. Consequently, the horizontal distance between the first recess 102 and the button 110 may be configured to be small and constant, such that the possibility of external liquid intrusion may be reduced.

On the other hand, the first through hole 104 is configured at the bottom of the first recess 102 and penetrates through the casing 100. Hence, the button 110 may press the button switch 162 in the casing 100 through the first through hole 104. In some embodiments, the first through hole 104 may be configured at the center of the bottom surface of the first recess 102, such that the button 110 and the resilient member 120 may be symmetrically configured with respect to the first through hole 104. Consequently, the stability of the waterproof button module 10 may be enhanced.

In some embodiments, the button 110 includes a body 112 and a pressing portion 114. The pressing portion 114 extends from the bottom surface of the body 112. Further, the pressing portion 114 may be perpendicular to the body 112 and disposed through the first through hole 104 to controllably press the button switch 162. More specifically, when a user presses the top surface of the body 112, the pressing portion 114 may synchronously move downward to press the button switch 162 through the resilient member 120 for achieving the purpose of turning on or turning off the button switch 162. In some embodiments, the button 110 may further include an enforcement rib 116 that is configured to enhance the structural strength of the button 110. The enforcement rib 116 is connected to the bottom surface of the body 112 and the pressing portion 114 respectively. The enforcement rib 116 may have a triangular cross section. When a user presses the button 110 at a position away from the central region of the top surface of the body 112, the enforcement rib 116 may not only prevent connection between the body 112 and the pressing portion 114 from being damaged but also facilitate transmission of pressing force to the button switch 162.

Figure 4:
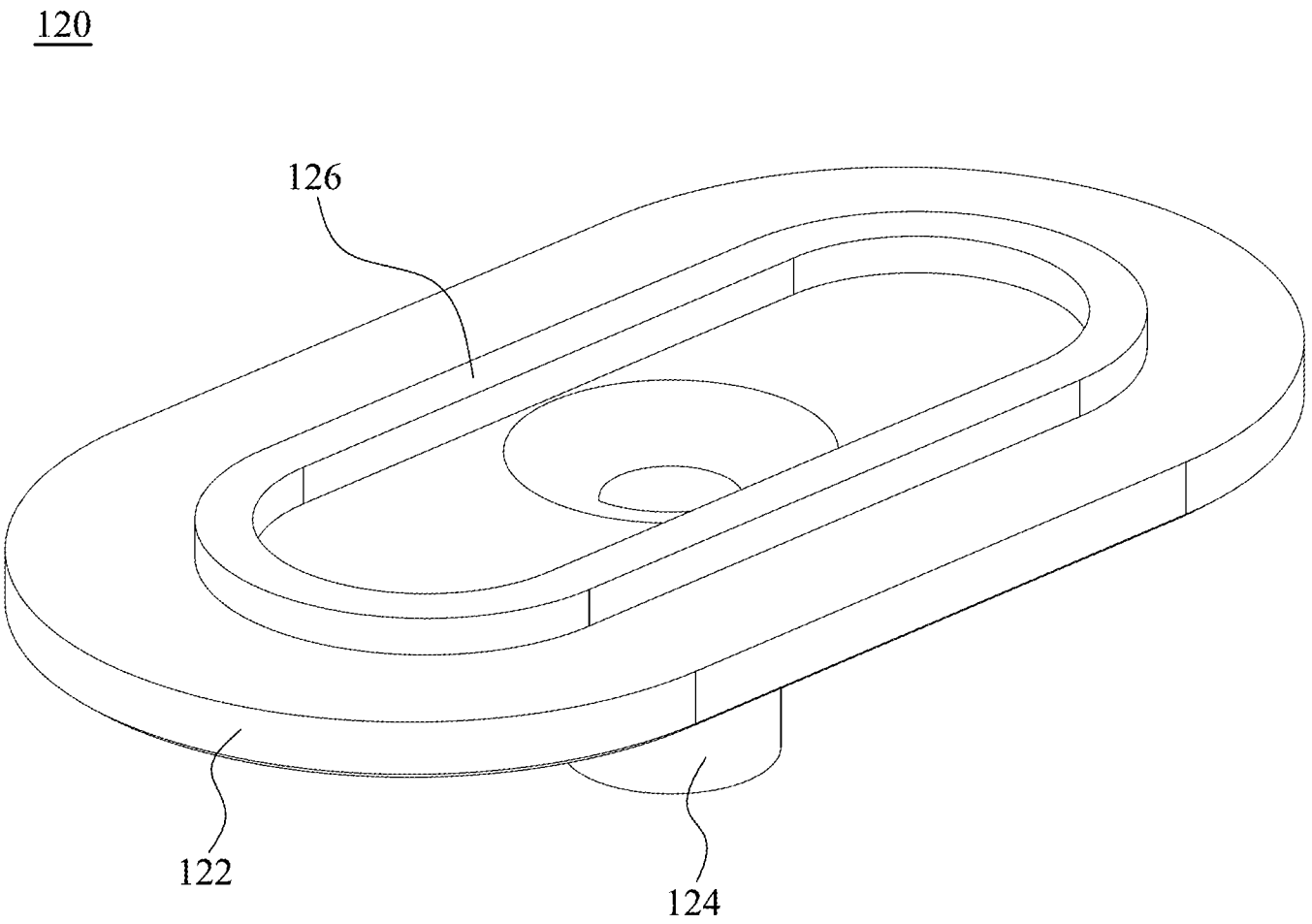
FIG. 4 is a schematic diagram illustrating a perspective view of a resilient member in accordance with some embodiments of the present disclosure.

Reference is made to FIGS. 2 and 4 together. FIG. 4 is a schematic diagram illustrating a perspective view of a resilient member 120 in accordance with some embodiments of the present disclosure. In some embodiments, the resilient member 120 includes a first portion 122 and a second portion 124. The resilient member 120 is accommodated in the first recess 102, configured between the button 110 and the bottom of the first recess 102, and covers the bottom surface of the body 112 and the pressing portion 114. More specifically, the first portion 122 is a portion of the resilient member 120 that does not overlap the first through hole 104 in a top view. The second portion 124 is a portion of the resilient member 120 that overlaps the first through hole 104 in a top view. The first portion 122 is horizontally disposed on and parallel to the bottom surface of the first recess 102. The second portion 124 is connected to the first portion 122 without a gap therebetween, perpendicular to the first portion 122, and extends through the first through hole 104. The second portion 124 further includes a hollow for accommodating the pressing portion 114. In some embodiments, the second portion 124 may be configured between and respectively abut against the pressing portion 114 and the button switch 162. That is, the pressing portion 114, the second portion 124, and the button switch 162 may be sequentially aligned and in contact with each other. Consequently, the pressing actuation of the button 110 by a user may be accurately and sensitively transmitted to the button switch 162. It should be noted that configuration of the pressing portion 114, the second portion 124, and the button switch 162 is not limited to the above-mentioned embodiments. For example, according to various designs, a gap may be configured between the second portion 124 and the button switch 162 to adjust the sensitivity of the button 110.

In some embodiments, the resilient member 120 includes a support portion 126 that is configured to support and rebound the button 110. More specifically, the support portion 126 may be a hollow cylinder and protrude upward from the top surface of the first portion 122. The annular structure of the support portion 126 may surround the entrance of the hollow of the second portion 124 in a top view. In addition, the top surface of the support portion 126 may be configured in parallel with the bottom surface of the body 112. When the button 110 is disposed on the resilient member 120, the top surface of the support portion 126 may completely fit and abut against the bottom surface of the body 112. Hence, external liquid may hardly pass through the interface of the support portion 126 and the body 112. On the other hand, due to the configuration of the support portion 126, a space may be provided between the body 112 and the first portion 122 of the resilient member 120 for accommodating the enforcement rib 116, such that hard interference between the enforcement rib 116 and the resilient member 120 may be prevented. In some embodiments, the contour of the support portion 126 may correspond to the contour of the button 110, such that the button 110 may be stacked on the resilient member 120 more stably. When a user presses the button 110 at a position away from the central region of the top surface of the body 112, the support portion 126 may reduce the inclination of the button 110, such that components in the waterproof button module 10 may remain firm and stable. Consequently, the life expectancy of the waterproof button module 10 may be increased.

In some embodiments, the first portion 122, the second portion 124, and the support portion 126 of the resilient member 120 include the same material. Further, the material may be selected from at least one of the group consisting of rubber, silicone, and other suitable materials. Since the resilient member 120 with a good elasticity is provided between the button 110 and the bottom of the first recess 102, after a user presses the button 110, a reverse force may be applied to the button 110 from the resilient member 120, such that the button 110 may be rebounded back to its original position accordingly.

Figure 3:
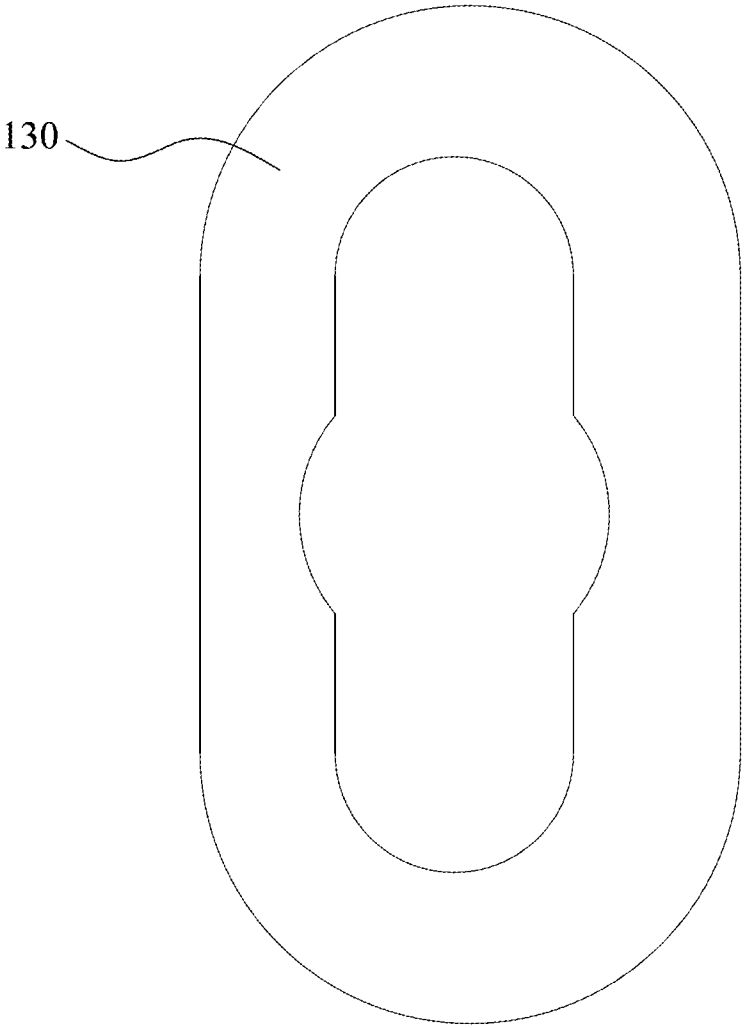
FIG. 3 is a schematic diagram illustrating a top view of a first waterproof portion in accordance with some embodiments of the present disclosure.

Reference is made to FIGS. 2 and 3 together. FIG. 3 is a schematic diagram illustrating a top view of a first waterproof portion 130 in accordance with some embodiments of the present disclosure. In some embodiments, the first waterproof portion 130 may be disposed between and respectively abut against the resilient member 120 and the first recess 102 in an airtight manner. More specifically, the first waterproof portion 130 may bond the bottom surface of the first portion 122 of the resilient member 120 and the bottom surface of the first recess 102 to each other. Further, the first waterproof portion 130 may completely surround the first through hole 104 in a top view. Due to the configuration of the first waterproof portion 130, the resilient member 120 may excellently seal the first through hole 104, such that external liquid cannot intrude into the casing 100 via the first through hole 104. In some embodiments, the first waterproof portion 130 and the support portion 126 may be respectively located on opposite sides of the first portion 122 and aligned with each other. That is, the support portion 126 may be stacked on the first waterproof portion 130 through the first portion 122. When a user presses the button 110, pressing force from the user may be transmitted to the first portion 122 and the first waterproof portion 130 therebelow through the support portion 126, such that the resilient member 120 and the first recess 102 may be bonded more tightly. It should be noted that the position of the first waterproof portion 130 is not limited to the above-mentioned embodiments. For example, according to various designs, the first waterproof portion 130 may be configured between the resilient member 120 and the sidewall of the first recess 102.

Reference is made to FIG. 2 again. In some embodiments, the casing 100 may include a second recess 106. More specifically, the second recess 106 is located below the surface of the casing 100. Further, the first recess 102 is formed at the bottom of the second recess 106. Consequently, the first recess 102 and the second recess 106 may have a step-shaped cross section.

In some embodiments, the waterproof button module 10 may include a button fixing component 150 that is configured to stabilize the button 110 and restrict the button 110 to move only in the vertical direction. More specifically, the button fixing component 150 is accommodated in the second recess 106 and has a second through hole 152. The contour of the second through hole 152 and contour of the body 112 of the button 110 may be conformal. In other words, the second through hole 152 may match the body 112 of the button 110. Consequently, the body 112 may penetrate through the second through hole 152, and thus exposed to external space via the second through hole 152 for facilitating user operation. In addition, since the body 112 and the second through hole 152 are conformal, the horizontal distance between the body 112 and the button fixing component 150 may be configured to be small and constant, such that possibility of external liquid intrusion may be reduced.

In some embodiments, the button 110 may include a protruding portion 118. More specifically, the protruding portion 118 may extend outward from the side of the body 112. Further, the protruding portion 118 may be configured along the contour of the body 112. When the button fixing component 150 is sleeved on the button 110, the protruding portion 118 may abut against the bottom surface of the button fixing component 150 accordingly, such that intrusion of external liquid may be prevented. Consequently, the waterproof button module 10 may further enhance its waterproof performance when the button 110 is not pressed.

Figure 5:
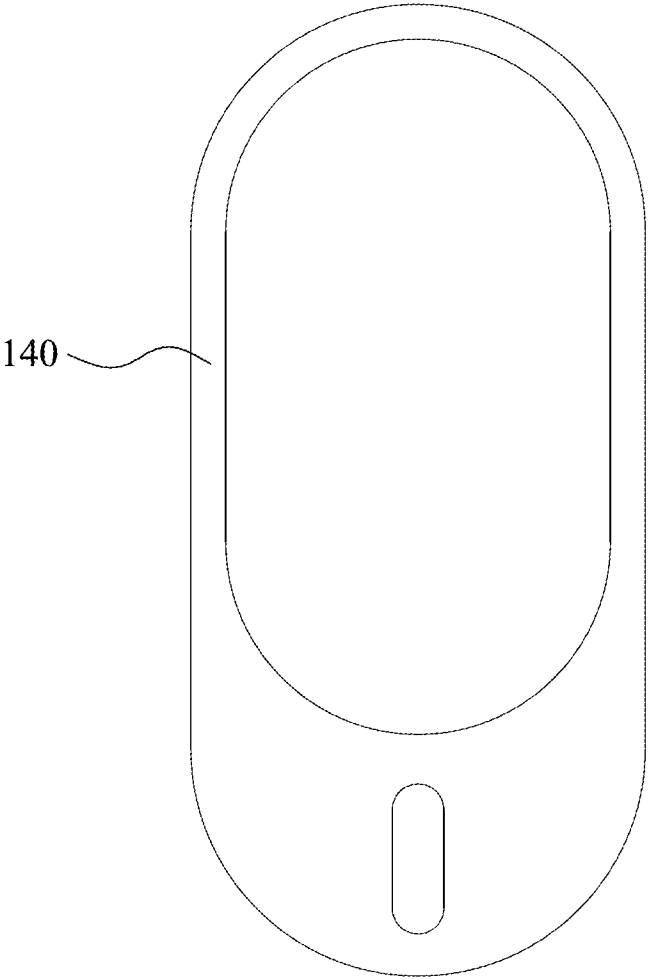
FIG. 5 is a schematic diagram illustrating a top view of a second waterproof portion in accordance with some embodiments of the present disclosure.

Reference is made to FIGS. 2 and 5 together. FIG. 5 is a schematic diagram illustrating a top view of a second waterproof portion 140 in accordance with some embodiments of the present disclosure. In some embodiments, the second waterproof portion 140 may be disposed between and respectively abut against the button fixing component 150 and the second recess 106 in an airtight manner. More specifically, the second waterproof portion 140 may bond the bottom surface of the button fixing component 150 and the bottom surface of the second recess 106 to each other. Further, the second waterproof portion 140 may completely surround the second through hole 152 in a top view. Due to the configuration of the second waterproof portion 140, external liquid cannot intrude into the waterproof button module 10 via the interface between the button fixing component 150 and the casing 100.

In some embodiments, the first waterproof portion 130 and the second waterproof portion 140 may include the same material. Further, the material may be selected from at least one of the group consisting of silicone, polyurethane, epoxy resin, and other suitable materials with good waterproof and adhesive properties. Consequently, since the waterproof portions are provided between components as described above, the waterproof button module 10 may not only have a firm and stable structure but also prevent external liquid from intruding into the casing 100 via gaps between the components.

According to the detailed descriptions above with respect to various embodiments of the present disclosure, it may be understood that the waterproof button module of the present disclosure may achieve a good waterproof performance through the configuration of the resilient member with specific shape and configuration of the waterproof portion between the button and the casing. In detail, the resilient member may cover the bottom of the button and the pressing portion. Further, the resilient member may be bonded to the bottom of the first recess of the casing through the first waterproof portion with an annular shape. The pressing portion of the button may penetrate through the bottom of the first recess of the casing, so as to press the button switch in the casing through the resilient member. The button, the resilient member, the first waterproof portion and the casing are sequentially stacked from top to bottom, such that intrusion of external liquid into the casing may be effectively prevented. In addition, due to sequentially stacked configuration of the button fixing component, the second waterproof portion, and the second recess, the waterproof button module may further enhance its waterproof performance when the button is not pressed. On the other hand, the resilient member may include a support portion which is disposed on the top surface thereof and configured to abut against the bottom of the button. After the button is pressed, a reverse force from the resilient member may be applied to the button through the support portion, such that the button may be rebounded back to its original position accordingly. Consequently, the waterproof button module of the present disclosure may replace the conventional spring with the resilient member to further reduce the volume thereof. In addition, the resilient member and the waterproof portion of the present disclosure may be configured to be stationary, such that frictional damage to the resilient member and the waterproof portion due to the casing may be avoided, and thus life expectancy of the waterproof button module may be prolonged.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the scope of the present disclosure, and it is envisaged that various changes, substitutions, and alterations may be made.

What is claimed is:

1. A waterproof button module, comprising:

a casing having a first recess and a first through hole located at a bottom of the first recess;

a button in the first recess and partially passing through the first through hole, the button comprising a body and a pressing portion extending from a bottom surface of the body;

a resilient member in the first recess, wherein the button and the bottom of the first recess are respectively disposed on opposite sides of the resilient member, and the resilient member comprises:

a first portion below the bottom surface of the body;

a second portion connected to the first portion, extending through the first through hole, and having a hollow that accommodates the pressing portion; and a support portion connected to a top surface of the first portion, abutting against the bottom surface of the body, and surrounding the second portion; and a first waterproof portion surrounding the first through hole and abutting against the resilient member and the first recess in an airtight manner.

2. The waterproof button module of claim 1, wherein the button further comprises an enforcement rib connected between the bottom surface of the body and the pressing portion.

3. The waterproof button module of claim 1, wherein the support portion and the first waterproof portion are located on opposite sides of the first portion respectively and aligned with each other.

4. The waterproof button module of claim 1, wherein the casing further comprises a second recess having a bottom at which the first recess is formed.

5. The waterproof button module of claim 4, further comprising a button fixing component in the second recess and having a second through hole, wherein the button passes through the second through hole.

6. The waterproof button module of claim 5, further comprising a second waterproof portion surrounding the button and abutting against the button fixing component and the second recess in an airtight manner.

7. The waterproof button module of claim 5, wherein the button comprises a body and a protruding portion connected to a side surface of the body and movably abutting against a bottom surface of the button fixing component.

8. The waterproof button module of claim 1, further comprising a printed circuit board (PCB) fixed to the casing and comprising a button switch, wherein the resilient member abuts against and is between the button switch and the button.

* * * * *